United States Patent [19]

Kume

[11] 4,312,057

[45] Jan. 19, 1982

[54] ELECTRONIC TIMEPIECE PROVIDING AUDIBLE AND VISIBLE TIME INDICATIONS

[75] Inventor: Kazunari Kume, Tokorozawa, Japan

[73] Assignee: Citizen Watch Company Limited, Tokyo, Japan

[21] Appl. No.: 966,917

[22] Filed: Dec. 6, 1978

[30] Foreign Application Priority Data

Dec. 12, 1977 [JP] Japan ..... 52-149112

[51] Int. Cl.[3] ..... G04B 21/08

[52] U.S. Cl. ..... 368/63; 368/71; 368/72; 368/243; 368/250

[58] Field of Search ..... 58/23 R, 57.5, 152 B, 58/16 R, 16 D, 21.13, 14; 340/384 E; 368/62, 63, 71, 72, 243, 250

[56] References Cited

U.S. PATENT DOCUMENTS

| | | | |
|---|---|---|---|
| 3,938,317 | 2/1976 | Spano | 58/23 R |
| 3,998,045 | 12/1976 | Lester | 58/23 R |
| 4,037,200 | 7/1977 | Cranmer | 340/384 E X |
| 4,078,376 | 3/1978 | Freeman | 58/57.5 X |

*Primary Examiner*—Ulysses Weldon
*Attorney, Agent, or Firm*—Jordan and Hamburg

[57] ABSTRACT

An electronic timepiece is arranged to give an audible time signal indicative of the current time when a user operates an externally manually operable switch means. The operation of the switch means causes a signal emitting means responsive to information relating to the current time to emit a time signal which preferably includes a portion representing a zone within which the current time lies, and a further portion indicative of the current unit of time within the zone. In a preferred embodiment, the signal comprises two parts, one indicating the current hour and the other indicating the current minute.

13 Claims, 15 Drawing Figures

OSCILLATOR CIRCUIT
FREQUENCY DIVIDER
SOUND PRODUCING ELEMENT
P1
P0
901
902
903
904
905
906
907
838
839
841
851
852
853
854
857
862
863
864
866
867
870
833
834
835
836
837
827
828

LATCHING CIRCUIT
301
304
305
306
307
3
7
701
715
718
710
707
705
714
712
711
729
859
869
814
815
809
810
813
824
825
826
822
823
818
816
861
865

ELECTRONIC TIMEPIECE PROVIDING AUDIBLE AND VISIBLE TIME INDICATIONS

TECHNICAL FIELD

The present invention relates to an electronic timepiece of a type which provides audible time information.

BACKGROUND ART

A conventionally available timepiece of the type described can but produce a tone automatically on the hour. Such sound therefore permits the user to perceive time only in a passive way and this type of function is secondary for a timepiece. In the field of mechanically operated timepieces, a watch adapted to provide sound indicative of time information and the like has been proposed to facilitate active perception of time information. However, this kind of mechanical timepiece involves inherently intricate time detection means and time information means which offer an obstruction to the reduction of overall dimensions.

DISCLOSURE OF INVENTION

In accordance with the invention there is provided an electronic timepiece comprising, in combination: oscillator circuit means for providing a standard signal; divider circuit means dividing down said standard signal to provide low frequency signal; time counter circuit means responsive to said low frequency signal to provide information indicative of current time; display means for providing a visible display of said current time; store means for storing said signal relating to the current time; first discriminating circuit means coupled to said store means for discriminating a zone within which the current time lies to provide a first output signal indicative of said zone; second discriminating circuit means coupled to said store means for discriminating a current unit of time within said zone to provide a second output signal indicative of said current unit of time; signal producing means responsive to said first and second output signals to provide a time division signal and a time indication signal, respectively; and signal emitting means responsive to said time division signal and said time indication signal and emitting an audible time signal composed of a signal representative of a zone within which the current time lies, and a signal indicative of the current unit of time within said zone.

The timepiece of the invention permits auditory perception of time information in an active manner, i.e. whenever the user actuates the switch means to obtain the information. This enables the user to determine the current time even in the dark without looking at a visual display device.

DETAILED DESCRIPTION OF DRAWINGS

Figure 1:
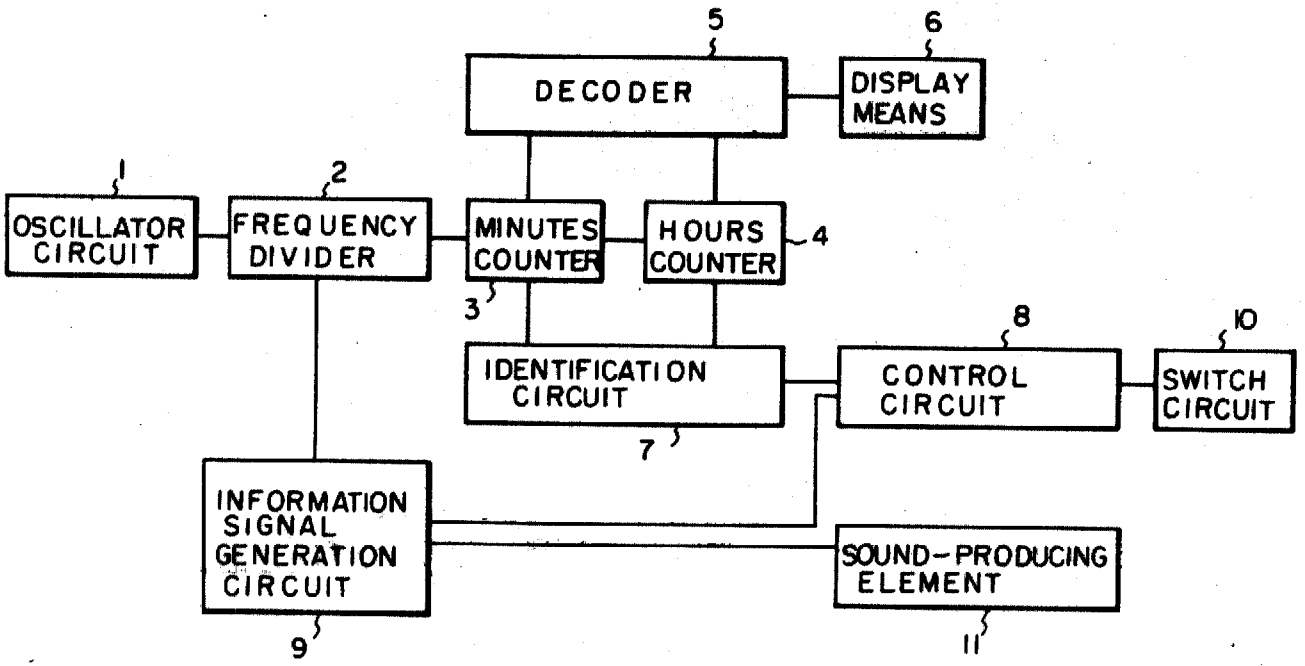
FIG. 1 is a block diagram showing an embodiment of a digital timepiece in accordance with the invention.
Figures 2, 2A, 2B, 2C:
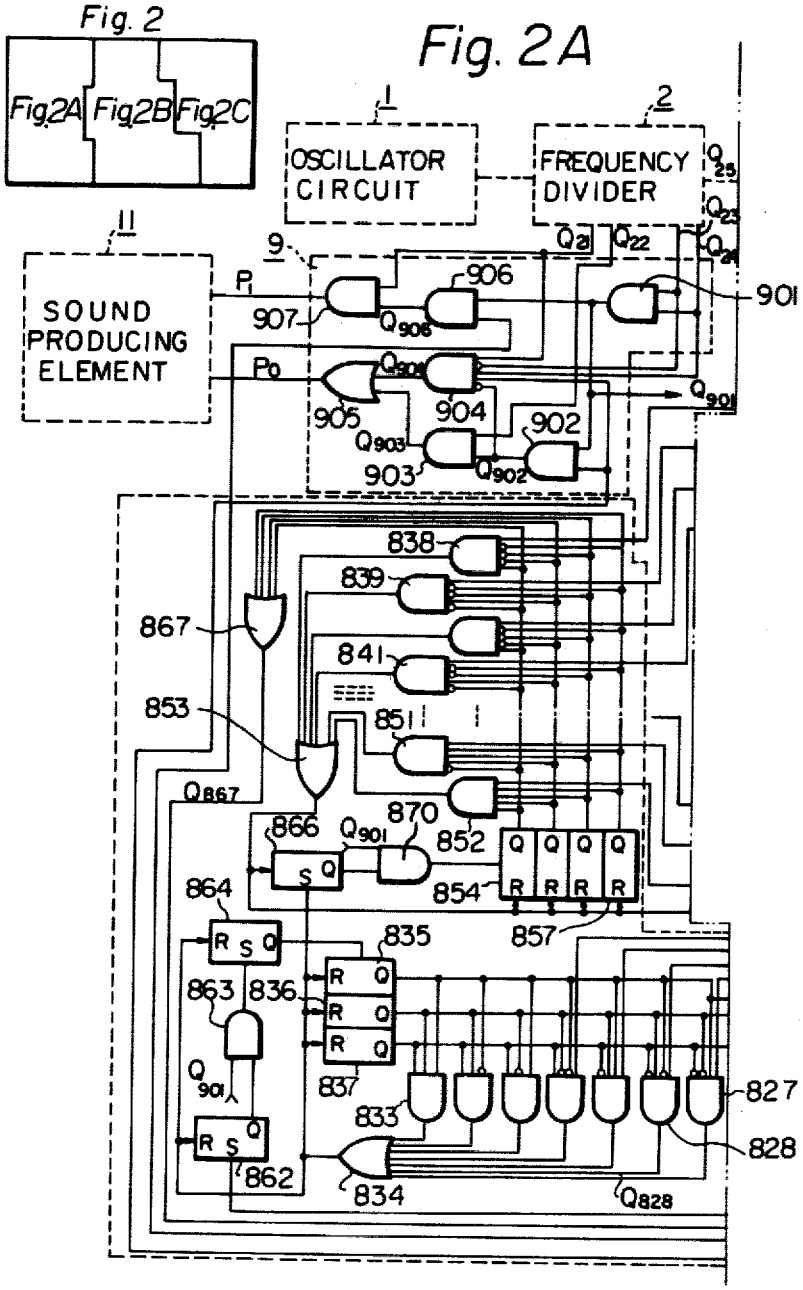
FIGS. 2A to 2C are a circuit diagram of part of the timepiece of FIG. 1.
Figure 2B:
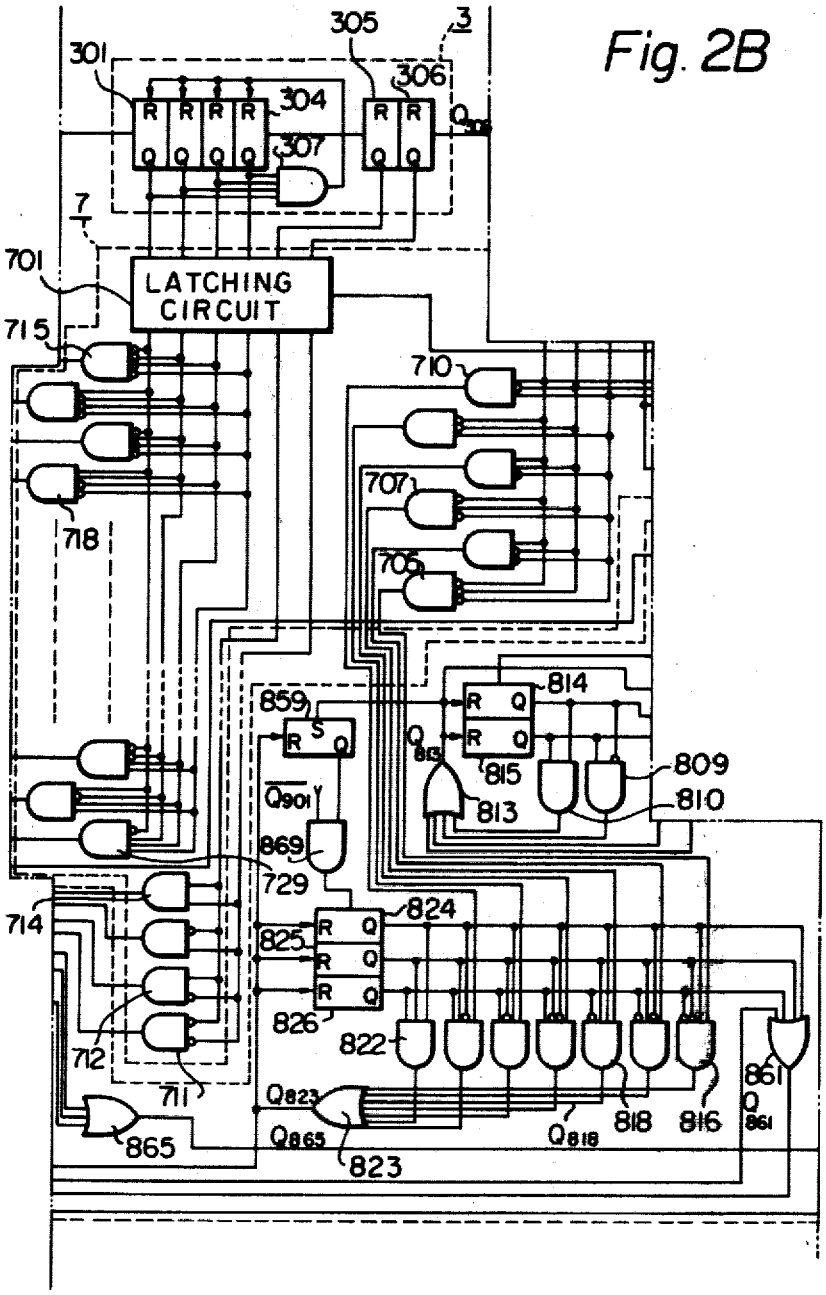
Figure 2C:
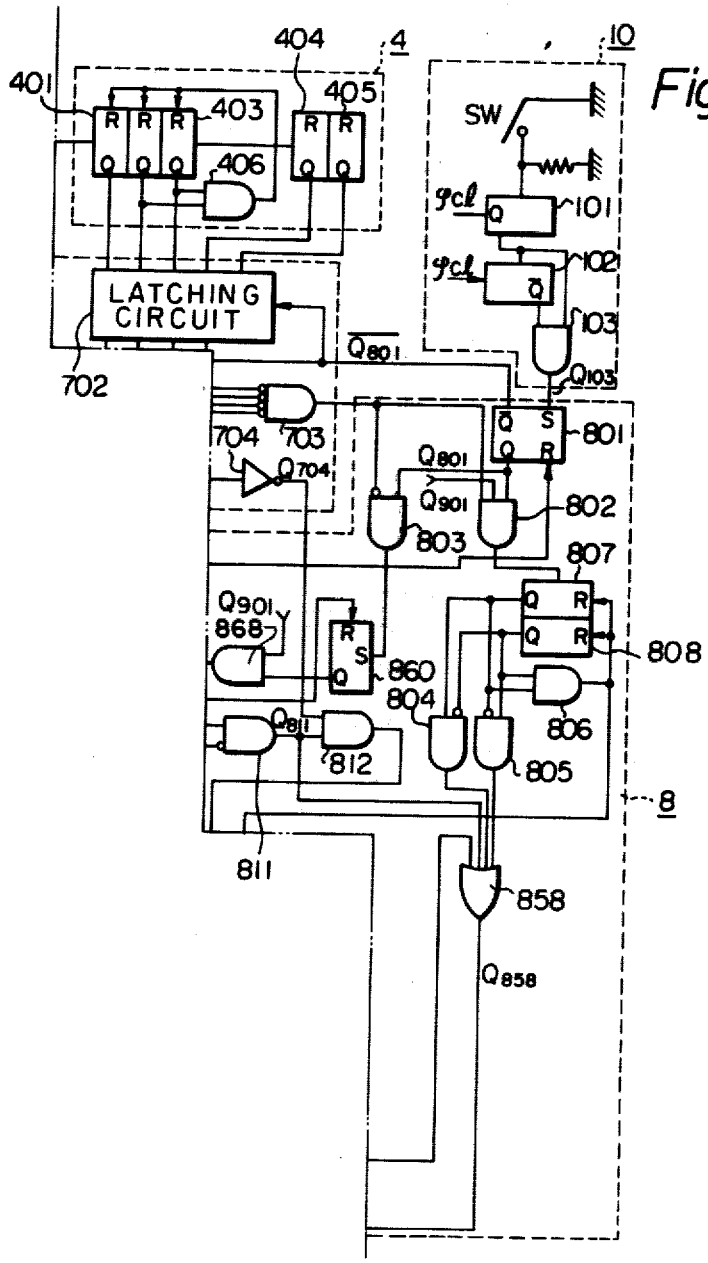

FIG. 1 shows in block diagram the general construction of a digital timepiece in accordance with the invention and of the type which displays hours and minutes.

An oscillation circuit 1 including a quartz crystal vibrator provides a standard signal (having a frequency of 32,768 Hz in the illustrated embodiment). The frequency of this standard signal is divided by a frequency divider 2 down to 1/60 Hz. A minutes counter 3 counting in response to the output of the frequency divider 2 counts 60 minutes (1 hour) and thereupon provides an hour signal. Every hour signal from the minutes counter 3 is passed to an hours counter 4 which is capable of counting 24 hours. (Though a 24-hour counter is employed in this embodiment, the present invention is practicable using a 12-hour counter). A decoder 5 responsive to the outputs of the counters 3 and 4 provides drive pulses for driving a display means 6 (comprising liquid crystal cells in the illustrated embodiment). The user is thus provided with a visual indication of the current time.

An identification circuit 7 constantly stores the latest data provided by the minutes counter 3 and hours counter 4. The time data stored in the circuit 7 is transformed into audible information, provided by a sound-producing element 11 (incorporating a piezoelectric vibrator in this embodiment), using an output signal of an information signal generation circuit 9. This is performed under the control of a control circuit 8 which is operated by a switch circuit 10 including an externally manipulatable member. When the user operates the switch circuit 10 by means of the manipulatable member in order to determine the current time, the control circuit 8 commands the identification circuit 7 to hold the contents of the counters 3 and 4 while, at the same time, drawing the data out of the circuit 7. Controlled by the circuit 8, an output signal of the information signal generator 9 actuates the sound-producing element 11 to convert the time data into audible information.

In the above embodiment, the identification circuit 7 has been described as constantly holding the contents of the counters 3 and 4. As an alternative, there may be employed an arrangement wherein the control circuit 8 upon reception of a command from the switch circuit 10 causes the circuit 7 to hold the contents of the counters 3 and 4 only temporarily while drawing the data out of the circuit 7; the following procedure would be common to that discussed in conjunction with FIG. 1.

Details of the construction depicted in FIG. 1 will hereinafter be described with reference to FIGS. 2A–2C, 3A to 3D, 4A to 4D and 5A to 5C.

When a member SW included in the switch circuit 10 is depressed by the user, flip-flops 101 and 102 and an AND gate 103 provide a signal output $Q_{103}$. In the illustrated circuitry, clock pulses $Q_{cl}$ fed to the flip-flops 101 and 102 have a frequency of 64 Hz (see FIG. 3A).

Figure 3A:
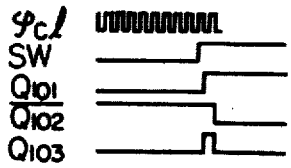
FIGS. 3A to 3D, 4A–4D and 5A–5C show the waveforms of signals appearing at various portions of the circuit depicted in FIGS. 2A to 2C.
Figure 3B:
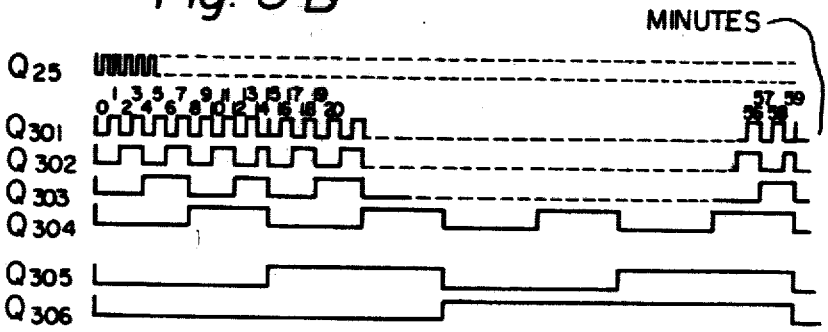
Figure 3C:
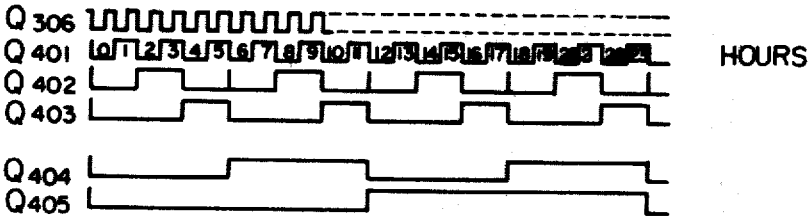
Figure 3D:
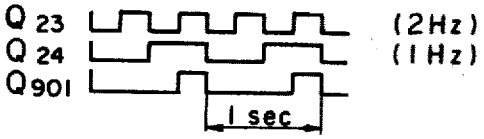

The minutes counter 3 receives output pulses $Q_{25}$ (1/60 Hz) from the frequency divider 2 and comprises flip-flops 301–304, which together with an AND gate 307 constitute a 15-minute counter, and flip-flops 305 and 306 constituting a 1-hour counter (see FIG. 3B). A 1-hour output pulse $Q_{306}$ of the minutes counter 3 is applied to the hours counter 4 which is made up of a 6-hour counter consisting of flip-flops 401–403 and an AND gate 406, and a 24-hour counter consisting of flip-flops 404 and 405 (see FIG. 3C).

The outputs of the flip-flops 301–306 of the minutes counter 3 are connected to a latching circuit 701 of identification circuit 7. Likewise, the outputs of the flip-flops 401–405 of the hours counter 4 are connected to another latching circuit 702 of the circuit 7. The latching circuits 701 and 702 are controlled by an output $Q_{801}$ of a flip-flop 801 included in the control circuit 8. When the signal $Q_{801}$ is at logical "1" level, the outputs of the latching circuits 701 and 702 are equal to those of the flip-flops 301–306 and 401–405 associated therewith. When the signal $Q_{801}$ is at logical "0" level, the latching circuits 701 and 702 hold their outputs at constant levels.

The identification circuit 7 includes various gates adapted to provide signals identifying the current time. A NOR gate 703 discriminates 0 hour and 12 hours from other hours. An inverter 704 determines whether the current hour lies between 0–5 hours (12–17 hours) or between 6–11 hours (18–23) hours. Gates 705–710 which are combinations of AND gates and inverters are adapted to distinguish between 0, 1, 2, 3, 4 and 5 hours, 6, 7, 8, 9, 10 and 11 hours, 12, 13, 14, 15, 16 and 17 hours or 18, 19, 20, 21, 22 and 23 hours, respectively. The identification of the hours portion of the current time is performed on the basis of the logic levels at the outputs of the latching circuit 702, which correspond to stored values of the outputs of flip-flops 401–405 (see the waveforms shown in FIG. 3C).

In a corresponding manner, gates 711–714, comprising AND gates or combinations of AND gates and inverters, are responsive to respective zones of current time which are 0–14 minutes, 15–29 minutes, 30–44 minutes and 45–59 minutes, in one of which the data of the minutes counter 3 passed to the latching circuit 701 lies. Furthermore, gates 715–729 are provided to identify the current time within each 15-minute zone.

Signals $Q_{23}$ (2 Hz) and $Q_{24}$ (1 Hz) are applied from an intermediate stage of the frequency divider 2 to an AND gate 901 of the information signal generator 9 and thereby converted into a basic timing signal (hereinafter abbreviated to basic signal) $Q_{901}$ having a period of 1 second and a duration of ¼ second. The signal $Q_{901}$ (FIG. 3D) is used for driving the soundproducing element 11.

The flip-flop 801 of the control circuit 8 serves as a switch means which operates the control circuit in response to the output $Q_{103}$ of the switch circuit 10.

An AND gate 802 included in the control circuit is adapted to identify 0 hour (12 hours) whereas a gate 803 employing the combination of an AND gate and an inverter identifies hours other than 0 hour (12 hours). Gates 804, 805 and 806 and flip-flops 807 and 808 are used to provide time-informing tones on 0 and 12 hours. Gates 809–813 and flip-flops 814 and 815 also provide time-informing tones.

To facilitate a ready understanding of the following description, time informing sounds and current times are tabulated below. In this embodiment, two different sounds are used: sound A (division sound) having two consecutively occurring tones of frequencies 4096 Hz and 2048 Hz, and sound B (time indication sound) having a tone of the frequency 4096 Hz. Table 1 lists tones indicative of the hours of the current time, while Table 2 lists tones indicative of the minutes. In the tables, "A" represents one A sound and "2A" represents two A sounds; "B" indicates one B sound, "2B" indicates two B sounds and so forth up to "14B". In order to promote easy perception of time, each sound A when indicating hours represents an interval of 6 hours and when indicating minutes an interval of 15 minutes. Sound B indicates both for hours and minutes the number of hours or minutes from the time represented by sound A.

TABLE 1

| Hours | Sound | Hours | Sound | Hours | Sound | Hours | Sound |
|---|---|---|---|---|---|---|---|
| 0 | 2A | 6 | A | 12 | 2A | 18 | A |
| 1 | B | 7 | A + B | 13 | B | 19 | A + B |
| 2 | 2B | 8 | A + 2B | 14 | 2B | 20 | A + 2B |
| 3 | 3B | 9 | A + 3B | 15 | 3B | 21 | A + 3B |
| 4 | 4B | 10 | A + 4B | 16 | 4B | 22 | A + 4B |
| 5 | 5B | 11 | A + 5B | 17 | 5B | 23 | A + 5B |

TABLE 2

| Minutes | Sound | Minutes | Sound | Minutes | Sound | Minutes | Sound |
|---|---|---|---|---|---|---|---|
| 0 | None | 15 | A | 30 | 2A | 45 | 3A |
| 1 | B | 16 | A + B | 31 | 2A + B | 46 | 3A + B |
| 2 | 2B | 17 | A + 2B | 32 | 2A + 2B | 47 | 3A + 2B |
| 3 | 3B | 18 | A + 3B | 33 | 2A + 3B | 48 | 3A + 3B |
| . | . | . | . | . | . | . | . |
| . | . | . | . | . | . | . | . |
| . | . | . | . | . | . | . | . |
| . | . | . | . | . | . | . | . |
| 12 | 12B | 27 | A + 12B | 42 | 2A + 12B | 57 | 3A + 12B |
| 13 | 13B | 28 | A + 13B | 43 | 2A + 13B | 58 | 3A + 13B |
| 14 | 14B | 29 | A + 14B | 44 | 2A + 14B | 59 | 3A + 14B |

For example, at 8:18, the user will identify 6 hours represented by the first sound A and then 8 hours upon production of two B sounds following Sound A. Next, he or she hears sound A, indicating 15 minutes, and then three B sounds to perceive 18 minutes.

Turning back to FIGS. 2 and 3, the gates 804–806 and flip-flops 807 and 808 are operated only for providing the hours division sounds at 0 and 12 hours. The gates 809–813 and flip-flops 814 and 815 are used for providing the hours division sounds at hours other than 0 and 12 hours (in practice, the hours division sounds are omitted in the embodiment for 1–5 hours and 13–17 hours). Meanwhile, gates 816–823 and flip-flops 824, 825 and 826 are used to provide hours indication sounds. Gates 827–834 and flip-flops 835, 836 and 837 are used to provide minutes division sounds whereas gates 838–853 and flip-flops 854–857 provide minutes indication sounds.

The timepiece thus constructed according to the invention is operated as follows:

When the member SW of the switch circuit 10 is depressed, the signal $Q_{103}$ momentarily adopts the logical "1" level, thereby turning the output $Q_{801}$ of the switch circuit 801 to "0". As a result, minutes data from the flip-flops 301–306 and hours data from the flip-flops 401–405 are held in the latching circuits 701 and 702, respectively. The other output $Q_{801}$ of the switch circuit 801 adopts the "1" level, thereby actuating the gates 802 and 803. Assuming that the content of the latching circuit 702 indicates 0 or 12 hours, the gate 802 is opened with the gate 803 kept closed. The basic signal $Q_{901}$ is thus allowed to pass through the gate 802 to the flip-flops 807 and 808. The gates 804 and 805 detect the states of the corresponding flip-flops 807 and 808 and pass them to a gate 858.

Figure 4A:
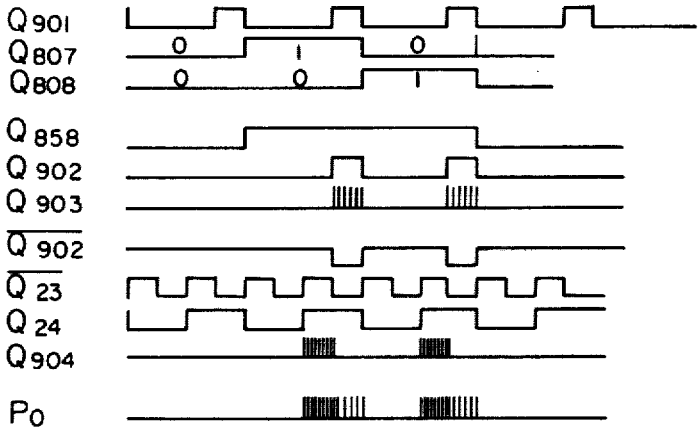

Gate 858 thereby produces a control signal $Q_{858}$ having the waveform shown in FIG. 4A which is input to an AND gate 902 of the information signal generator 9. The signal $Q_{901}$ is also applied to the AND gate 902, to provide an output $Q_{902}$ shown in FIG. 4A. An AND gate 903 combines the signal $Q_{902}$ with a tone modulation signal $Q_{22}$ (2048 Hz) to provide a signal $Q_{903}$ which is in the form of two pulses, each consisting of a 2048 Hz signal and having a duration of ¼ second, the repetition frequency of the pulses being 1 Hz (see FIG. 4A).

A gate 904 receives signals $Q_{858}$, $Q_{902}$, $Q_{23}$, $Q_{24}$ and a tone modulation signal $Q_{21}$ (4096 Hz) and produces an output $Q_{904}$ in the form of two pulses each consisting of a 4096 Hz signal and having a duration of ¼ second, the pulse repetition frequency being 1 Hz.

The gate outputs $Q_{903}$ and $Q_{904}$ are combined together by an OR gate 905 resulting in a signal output Po shown in FIG. 4A. As the signal Po is passed through a drive circuit (not shown) to the element 11, the element 11 twice produces a division sound having two consecutive tones with frequencies of 4096 Hz and 2048 Hz, respectively, informing the user of 0 or 12 hours.

At this instant, the AND gate 806 resets the flip-flops 807 and 808 (whose outputs $Q_{807}$ and $Q_{808}$ then adopt the "0" level) while setting the next switch circuit 859 via the OR gate 813.

It will be appreciated that the flip-flops 807 and 808 and the resetting gate 806 are so arranged that two pulses of the $Q_{901}$ signal are counted before the flip-flops are reset. The result of this is that the signal $Q_{858}$, which is passed to the information signal generator 9, has a logic "1" level while two pulses of the $Q_{901}$ signal are produced, and hence two division sounds are created.

If the current time is other than 0 hour (12 hours), the gate 803 instead of the gate 802 is operated to set a switch circuit 860 so that the basic signal $Q_{901}$ being applied to AND gate 868 varies the contents of the flip-flops 814 and 815. The outputs $Q_{814}$ and $Q_{815}$ of the flip-flops adopt the waveforms shown in FIG. 4B because of the resetting action of the gate 809 which receives the outputs. Accordingly, the output $Q_{811}$ of the gate 811, which also receives these outputs, adopts the illustrated waveform. This happens only if the content of the flip-flop 404 is "1" and hence the output $Q_{704}$ of the inverter 704 is "0", and indicates the time zone 6–11 hours or 18–23 hours.

The output $Q_{811}$ is passed sequentially through the gate 858 to the information signal generator 9 which then operates in the manner described above, except that only one division sound is produced because the signal $Q_{858}$ has a logic "1" level only while one pulse of the $Q_{901}$ signal is produced.

Figure 4B:
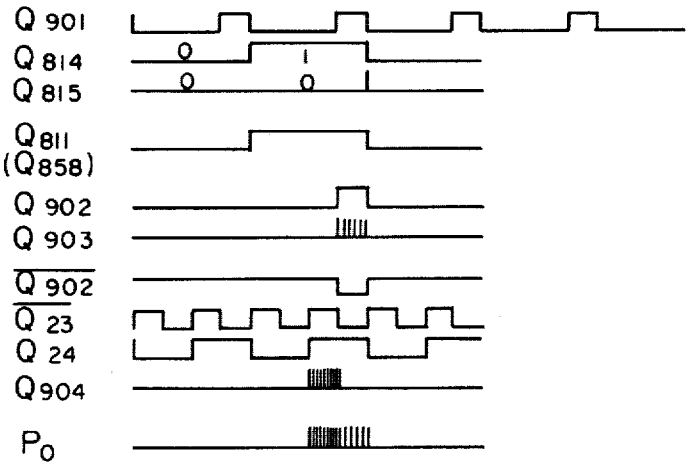

The gate 905 thus provides as output a time division signal Po represented in FIG. 4B, that is, a division sound made up of two tones of different frequencies is produced once, showing that the current time belongs to the time zone 6–11 hours or the time zone 18–23 hours.

Figure 4C:
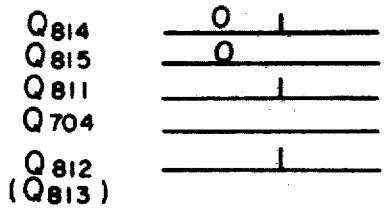

When the content of the flip-flop 404 is logical "0" representing 0–5 hours or 12–15 hours, the output $Q_{704}$ adopts the "1" level and makes the flip-flops 814 and 815 and gates 811, 812 and 813 provide outputs as shown in FIG. 4C, so that no division sounds are produced.

As the hours zone of the current time is thus identified by the presence or absence of the division sound, an output $Q_{813}$ (reset signal) of the gate 813 triggers the next switch circuit 859 while resetting the switch circuit 860.

Under the action of the switch circuit 859, the flip-flops 824–826 have their contents varied by the signal $Q_{901}$ being applied to AND gate 869 and identified by the gates 816–822. The outputs of some of the gates 816–822 and the OR gate 861 are illustrated in FIG. **4*d*. Assuming that the current time is 8 hours, the logical levels of flip-flops 401, 402 and 403 are "0", "1" and "0" (FIG. 3C) and therefore the output level $Q_{707}$ of the gate 707 is "1". The output $Q_{707}$ is passed to the gate 818 whose output level becomes "1" just when the output levels of the flip-flops 824, 825 and 826 adopt "1", "1" and "0" levels, respectively, resetting the flip-flops 824–826**.

Figure 4D:
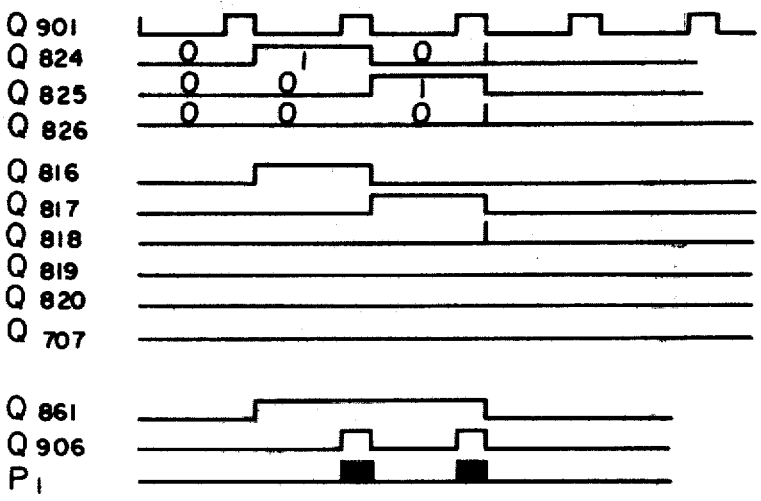

Consequently, the OR gate 861, and AND gate 906 of the circuit 9 and a gate 907 supplied with the signal $Q_{21}$ produce as outputs a control signal $Q_{861}$ and signals $Q_{906}$ and $P_1$ as shown in FIG. 4D. $P_1$ is a time indicating signal which comprises two bursts of 4096 Hz tone generated after the aforementioned set of division tones. Thus, the user hearing the division sound made up of 4096 Hz and 2048 Hz tones and the following two 4096 Hz tones identifies a current time of 8 hours.

When the output level $Q_{818}$ of the gate 818 becomes logical "1", the flip-flops 824–826 are reset and the switch circuit 859 is closed. An output $Q_{823}$ of the gate 823 (which is now common to output $Q_{818}$) actuates a switch circuit 862 whereafter an AND gate 863 fed with the signal $Q_{901}$ is operated to actuate a switch circuit 864. The switch circuits 862 and 864 and AND gate 863 are installed to cause a delay which provides clear discrimination between hours sound and minutes sound.

Assuming that the current time is 18 minutes after an hour, the logical levels of the flip-flops 305 and 306 are respectively "1" and "0" (FIG. 3B). These levels are fed to the input of the gate 712, and the output adopts the level "1". When in this state the flip-flops 835–837 adopt logical levels "0", "1" and "0", respectively, an output signal $Q_{828}$ of a gate 828 adopts the level "1", and this resets flip-flops 835–837 and switch circuits 862 and 864. Then gates 865, 858 and associated components produce outputs $Q_{865}$, $Q_{858}$ and the like as shown in FIG. 5 so that the gate 905 provides a signal $P_0$ which produces a sound consisting of consecutive 4096 Hz and 2048 Hz tones. As seen in Table 2, this is a division sound indicating the zone 15–29 minutes.

Thereupon, an output of the gate 834 actuates a switch circuit 866. This causes the flip-flops 854–857 to vary their contents in response to the signal $Q_{901}$ being applied to AND gate 870. Meanwhile, at a current time of 18 minutes, the four outputs of the latch circuit 701 of the circuit 7 corresponding to the flip-flops 301–304 are at logical "1", "1", "0" and "0" levels, rendering the output $Q_{718}$ of the gate 718 "1". As a consequence, when the flip-flops 854–857 have logical levels "0", "0", "1" and "0", respectively, the output level of the gate 841 becomes "1" whereby the switch circuit 866, flip-flops 854–857 and switch circuit 801 are reset thereby restoring the timepiece to its usual condition. At this instant, a control signal consisting of the output $Q_{867}$ of a gate 867 is applied via gate 861 to the AND gate 906 which then provides a signal $P_1$. Eventually, the 4096 Hz time indication tone occurs three times, which, in combination with the preceding division sound, indicates 18 minutes.

It will be appreciated from the above that counters in the form of flip-flops are used to count the pulses of a basic timing signal ($Q_{901}$). The number of pulses counted is determined by the information stored in the latching circuits 701 and 702. In this manner a signal having a duration corresponding to the number of pulses counted is passed to the generator 9, and the duration of this signal then determines how many time-informing sounds are produced.

Figure 5A:
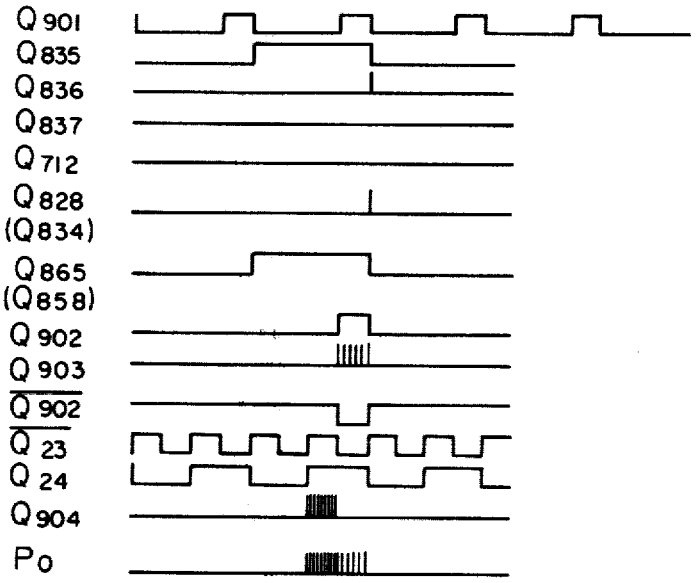
Figure 5B:
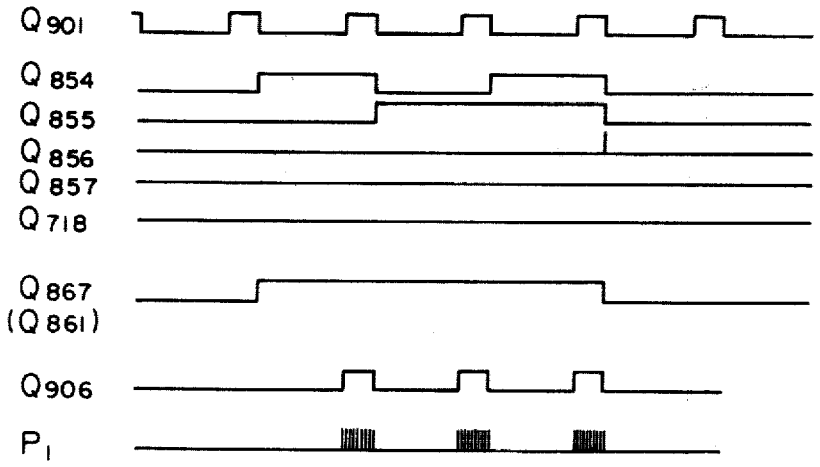
Figure 5C:
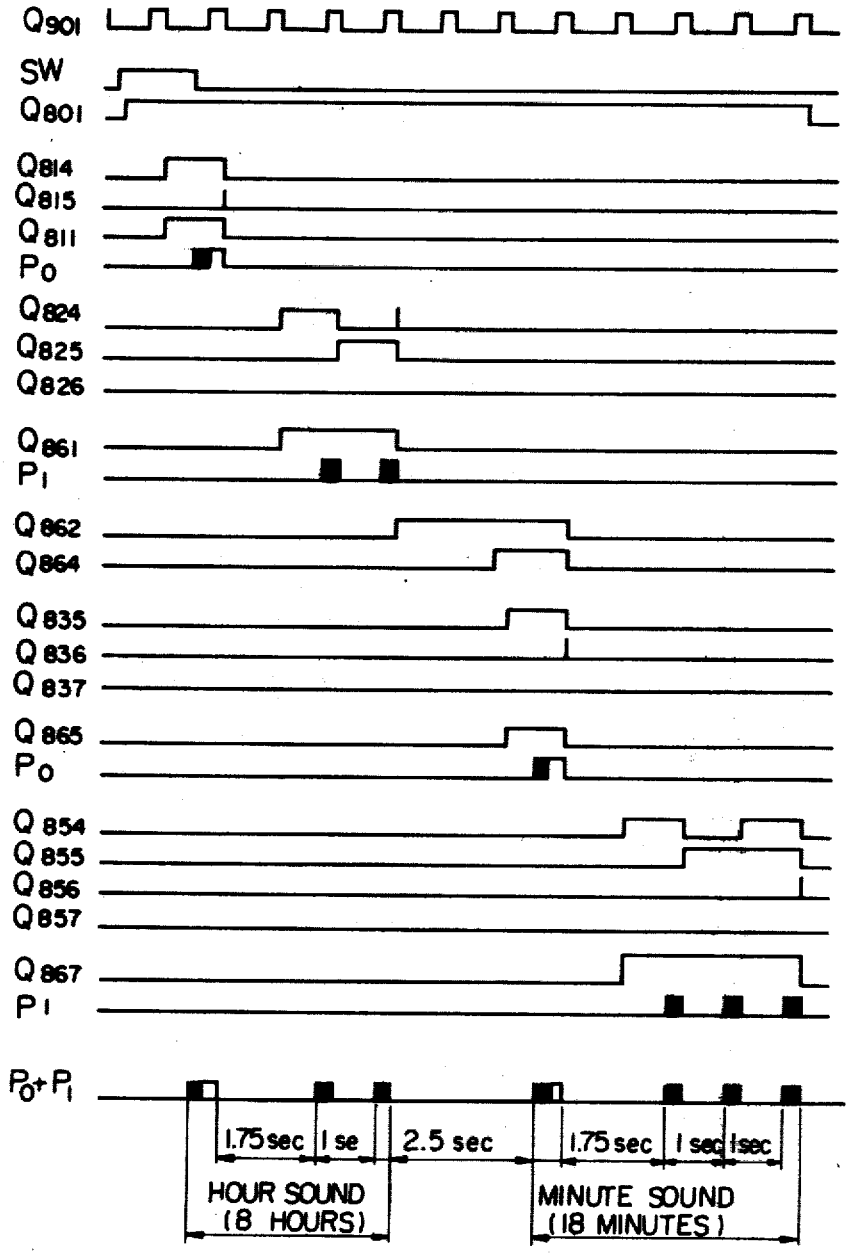

FIG. 5C is a time chart representing the procedures discussed above for the current time of 8:18.

As has thus far been described, the timepiece of the present embodiment produces a division sound representing a time zone and an indication sound representing actual current time and which occur with two different intervals. The user can therefore perceive the time-informing sounds with ease.

It will now be appreciated from the foregoing that a timepiece according to the present invention breaks entirely new ground in this art by affording audible indication of time. Existing auxiliary functions such as an alarm device may be employed in combination with the present invention. The present invention is applicable not only to a timepiece of the illustrated digital display type but also to that of an analog display type. When applied to a digital timepiece, the present invention can make the conventional illumination device (lamp) unnecessary.

To effect battery replacement without inconvenience, the timepiece of the invention may include a circuit which generates one pulse at the instant of connection of a new battery and feeds it to the reset terminal of the control circuit 8.

What is claimed is:

1. An electronic timepiece for providing audible and visible time indications, comprising:

a standard frequency oscillator circuit for producing a standard high frequency signal;

frequency divider circuit means for dividing the frequency of said standard high frequency signal to provide low frequency signals including a time unit signal and a basic timing signal;

time counter circuit means responsive to said time unit signal for producing information indicative of current time;

display means for visibly displaying said current time information;

an externally actuatable switch responsive to actuation thereof for producing a switching signal;

storage means responsive to said switching signal for storing said current time information;

first discrimination circuit means responsive to said current time information stored in said storage means for providing a signal representing a numeric value indicative of a time zone of said current time information;

second discrimination means responsive to said current time information stored in said storage means for providing a signal representing a numeric value indicative of a time unit of said current time information;

first electronic switch means responsive to said switching signal for transferring said basic timing signal to an output thereof;

first counter circuit means for counting said basic timing signal applied thereto from said output of said first electronic switch means;

first gate circuit means responsive to output signals from said first counter circuit means and said signal from said first discrimination means for detecting coincidence between a count in said first counter circuit means and said numeric value indicative of a time zone, and for producing an output signal when such coincidence is detected, said output signal being applied to said first electronic switch means to inhibit signal transfer thereby and to said first counter circuit means for resetting the count therein to a predetermined initial value;

second electronic switch means responsive to said output signal from said first gate circuit means for transferring said basic timing signal to an output thereof;

second counter circuit means for counting said basic timing signal applied thereto from said output of said second electronic switch means;

second gate circuit means responsive to output signals from said second counter circuit means and to said signal from said second discrimination circuit means for detecting coincidence between a count in said second counter circuit means and said numeric value indicative of a current time unit and for producing an output signal when such coincidence is detected, said output signal being applied to said second electronic switch means to inhibit signal transfer thereby and to said second counter circuit means for resetting the count thereof to a predetermined initial value;

third gate circuit means responsive to output signals from said first counter circuit means for producing a control signal having a duration proportional to a maximum count value attained by said first counter circuit means, said duration being zero or an integral number of periods of said basic timing signal;

fourth gate circuit means responsive to output signals from said second counter circuit means for producing a control signal having a duration proportional to a maximum count value attained by said second counter circuit means, said duration being zero or an integral number of periods of said basic timing signal;

tone signal producing means responsive to said control signal from said third gate circuit means for producing a time division signal comprising bursts of tone sequentially generated, with the number of said tone bursts being indicative of a time zone of current time, and further responsive to said control signal from said fourth gate circuit means for producing a time indication signal comprising bursts of tone sequentially generated, with the number of said tone bursts being indicative of a number of units of current time, said tone bursts indicative of a time zone being at least in part modulated at a different frequency from a modulation frequency of said tone bursts indicative of units of current time; and sound producing means responsive to said time division signal and said time indication signal for producing corresponding audible tone bursts, for thereby audible indicating current time as a time zone and as a time unit within that time zone.

2. An electronic timepiece according to claim 1, in which said time division signal indicates a time zone comprising a plurality of minutes and whereby said time indication signal indicates units of minutes.

3. An electronic timepiece according to claim 2, and further comprising means for generating a time division signal to indicate a plurality of hours and a time indication signal to indicate units of hours.

4. An electronic timepiece according to claim 3, in which said tone signal producing means produces a first tone burst indicative of an hours time zone, a group of tone bursts whose number is indicative of a number of units of hours, said units of hours indicating group of tone bursts being initiated after a first predetermined duration following said first tone burst and with a second predetermined duration being provided between each of said hours units indicating tone bursts, a group of tone bursts whose number is indicative of a minutes time zone, said minutes time zone indicating group of tone bursts being initiated after a third predetermined duration following said group of units of hours including tone bursts, and a group of tone bursts whose number is indicative of a number of units of minutes, said units of minutes tone burst being initiated after said first predetermined duration following said minutes time zone indicating group of tone bursts, with said second predetermined duration being provided between each of said units of minutes indicating tone bursts.

5. An electronic timepiece according to claim 4, in which said third predetermined duration is longer than said first and said second predetermined durations.

6. An electronic timepiece according to claim 5, in which said first predetermined duration is longer than said second predetermined duration.

7. An electronic timepiece according to claim 4, in which said hours time zone is of six hours duration, and in which current time within a first hours time zone is indicated by said first tone burst being generated and current time within a second hours time zone following said first hours time zone is indicated by omission of said first tone burst.

8. An electronic timepiece according to claim 4, in which said minutes time zones are each of 15 minutes duration.

9. An electronic timepiece according to claim 1, in which said frequency divider circuit means further produces first and second tone modulation signals of a frequency within the audible range, and wherein said tone signal producing means comprises;

a first modulation gate circuit coupled to receive said basic timing signal and said control signal from said third gate circuit, for producing an output signal modulated by said basic timing signal;

a second modulation gate circuit coupled to receive said first tone modulation signal and said output signal from said first modulation gate circuit, for producing said time division signal as tone bursts modulated at said first tone modulation signal frequency;

a third modulation gate circuit coupled to receive said basic timing signal and said control signal from said fourth gate circuit, for producing an output signal modulated by said basic timing signal; and a fourth modulation gate circuit coupled to receive said second tone modulation signal and said output signal from said third modulation gate circuit, for producing said time indication signal as tone bursts modulated at said second tone modulation signal frequency.

10. An electronic timepiece according to claim 1, in which said storage means comprises a set of latch circuits.

11. An electronic timepiece for providing audible and visible time indications, comprising:

circuit means for generating current time information, including at least hours and minutes of current time information;

display means responsive to said current time information for providing a visible time indication;

an externally actuatable switch responsive to actuation for producing a switching signal;

storage circuit means responsive to said switching signal for storing said current time information;

first discrimination circuit means coupled to said storage circuit means for detecting when the current time is within a first hours time zone extending from zero hours to six hours and is within a second hours time zone extending from eighteen hours to twenty-four hours, and for producing a first control signal indicative that the current time is within either of said first and second hours time zones;

second discrimination circuit means coupled to said storage circuit means for determining a number of units of hours of current time within said first and second hours time zones and for producing a second control signal having a duration proportional to said number of units of hours;

third discrimination circuit means coupled to said storage circuit means for detecting when the minutes of current time are within a first minutes time zone extending from zero minutes to fifteen minutes after an hour point, a second minutes time zone extending from fifteen minutes to thirty minutes after an hour point, a third minutes time zone extending from thirty minutes to forty-five minutes after an hour point, and a fourth minutes time zone extending from forty-five minutes to the next succeeding hour point, and for producing a third control signal of predetermined duration when the minutes of current time are detected to be within said second minutes time zone, a fourth control signal having a duration twice that of said third control signal when the minutes of current time are detected to be within said third minutes time zone, and a fifth control signal having a duration three times that of said third control signal when the minutes of current time are detected to be within said fourth minutes time zone;

fourth discrimination means coupled to said storage circuit means for determining a number of units of minutes of current time within one of said minutes time zones and for producing a sixth control signal having a duration proportional to said number of units of minutes;

tone signal producing means responsive to said first control signal for producing a first tone burst signal of first predetermined frequency and duration, responsive to said second control signal for producing a first group of serially generated tone burst signals with the number thereof being determined in accordance with the duration of said second control signal to be equal to said number of units of hours of current time, said first group of tone burst signals being initiated following a predetermined interval after said first tone burst signal, said tone signal producing means being further responsive to said third, fourth and fifth control signals for producing a second group of serially generated tone burst signals with the number thereof being one when said third control signal is received, being two when said fourth control signal is received, and being three when said fifth control signal is received, said second group of tone burst signals being initiated after a predetermined interval following said second group of tone burst signals, said tone signal producing means being further responsive to said sixth control signal for producing a third group of serially generated tone burst signals with the number thereof being determined in accordance with the duration of said sixth control signal to be equal to said number of units of minutes of current time, said third group of tone burst signals being initiated after a predetermined interval following said second group of tone burst signals, with the frequency of said first and third tone burst signals being different from the frequencies of siad second and fourth tone burst signals respectively, and with the duration of said time interval separating said second and third groups of tone burst signals being less than the duration of the time interval separating said first tone burst signal and said first group of tone burst signals; and sound-transducer means responsive to said first tone burst signal and to said first, second and third groups of tone burst signals for generating audible tone bursts corresponding thereto, for thereby providing an audible indication of current time information.

12. An electronic timepiece according to claim 11, in which said first tone burst signal and each tone burst in said third group of tone burst signals is composed of a pair of immediately sequential tone bursts of different frequencies.

13. An electronic timepiece according to claim 11, in which the frequencies in each tone burst of said second and fourth groups of tone burst signals are identical.

* * * * *